US011787167B2

(12) United States Patent
Biegelsen et al.

(10) Patent No.: US 11,787,167 B2
(45) Date of Patent: Oct. 17, 2023

(54) SECONDARY ROLLER FOR FOUNTAIN SOLUTION CONTACT ANGLE PINNING

(71) Applicants: Palo Alto Research Center Incorporated, Palo Alto, CA (US); Xerox Corporation, Norwalk, CT (US)

(72) Inventors: David K. Biegelsen, Portola Valley, CA (US); Joerg Martini, San Francisco, CA (US); Gregory B. Anderson, Emerald Hills, CA (US); Jengping Lu, Fremont, CA (US); Palghat S. Ramesh, Pittsford, NY (US); Anne Plochowietz, Mountain View, CA (US)

(73) Assignee: Xerox Corporation, Norwalk, CT (US)

( * ) Notice: Subject to any disclaimer, the term of this patent is extended or adjusted under 35 U.S.C. 154(b) by 17 days.

(21) Appl. No.: 17/579,381

(22) Filed: Jan. 19, 2022

(65) Prior Publication Data

US 2022/0227125 A1 Jul. 21, 2022

Related U.S. Application Data

(60) Provisional application No. 63/139,181, filed on Jan. 19, 2021.

(51) Int. Cl.
*B41M 1/06* (2006.01)
*B41F 7/02* (2006.01)
(Continued)

(52) U.S. Cl.
CPC ..... *B41F 13/08* (2013.01); *B41C 1/1041* (2013.01); *B41F 7/02* (2013.01); *B41F 7/08* (2013.01);
(Continued)

(58) Field of Classification Search
CPC ..... B41P 2227/20; B41F 13/08; B41F 7/02; B41F 7/08; B41F 7/26; B41F 31/002;
(Continued)

(56) References Cited

U.S. PATENT DOCUMENTS

2012/0103212 A1 5/2012 Stowe et al.
2012/0103221 A1 5/2012 Stowe et al.
2020/0016885 A1* 1/2020 Williams ..... G03G 21/0088

OTHER PUBLICATIONS

Co-pending U.S. Appl. No. 17/152,630, filed Jan. 19, 2021.
(Continued)

*Primary Examiner* — Matthew G Marini
*Assistant Examiner* — Leo T Hinze
(74) *Attorney, Agent, or Firm* — Caesar Rivise, PC

(57) ABSTRACT

Ink-based digital printing systems useful for ink printing include a secondary roller having a rotatable reimageable surface layer configured to receive fountain solution. The fountain solution layer is patterned on the secondary roller and then partially transferred to an imaging blanket, where the fountain solution image is inked. The resulting ink image may be transferred to a print substrate. To achieve a very high-resolution (e.g., 1200-dpi, over 900-dpi) print with these secondary roller configurations, an equivalent very high-resolution fountain solution image needs to be transferred from the secondary roller onto the imaging blanket. To increase the resolution of the image on the secondary roller, examples include a textured surface layer added to the secondary roller for contact angle pinning the fountain solution on the roll. Approaches to introduce a microstructure onto the surface layer of the secondary roller, and also superoleophobic surface coatings are described.

20 Claims, 6 Drawing Sheets

(51) Int. Cl.

| | |
|---|---|
| ***B41F 13/08*** | (2006.01) |
| ***B41J 2/34*** | (2006.01) |
| ***B41J 2/335*** | (2006.01) |
| ***B41C 1/10*** | (2006.01) |
| ***B41F 7/08*** | (2006.01) |
| ***B41F 7/26*** | (2006.01) |
| ***B41F 31/00*** | (2006.01) |
| ***B41F 31/13*** | (2006.01) |
| ***B41F 31/08*** | (2006.01) |
| ***B41N 3/03*** | (2006.01) |

(52) U.S. Cl.
CPC ..... *B41F 7/26* (2013.01); *B41F 31/002* (2013.01); *B41F 31/08* (2013.01); *B41F 31/13* (2013.01); *B41J 2/33535* (2013.01); *B41J 2/34* (2013.01); *B41M 1/06* (2013.01); *B41N 3/03* (2013.01); *B41C 1/1033* (2013.01); *B41P 2227/70* (2013.01)

(58) Field of Classification Search
CPC ..... B41F 31/08; B41F 31/13; B41F 7/265; B41F 7/30; B41F 23/0409; B41F 31/06; B41F 31/20; B41F 31/28; B41F 33/0054; B41F 7/00; B41C 1/1041; B41C 1/1033; B41M 1/06; B41M 5/0256; B41N 3/03
See application file for complete search history.

(56) References Cited

OTHER PUBLICATIONS

Co-pending U.S. Appl. No. 17/152,597, filed Jan. 19, 2021.
Co-pending U.S. Appl. No. 17/152,538, filed Jan. 19, 2021.
Co-pending U.S. Appl. No. 17/152,574, filed Jan. 19, 2021.
Co-pending U.S. Appl. No. 17/384,312, filed Jul. 23, 2021.
Co-pending U.S. Appl. No. 17/494,208, filed Oct. 5, 2021.
Co-pending U.S. Appl. No. 17/546,108, filed Dec. 9, 2021.

* cited by examiner

SECONDARY ROLLER FOR FOUNTAIN SOLUTION CONTACT ANGLE PINNING

FIELD OF DISCLOSURE

The present disclosure is related to marking and printing systems, and more specifically to variable data lithography system using a secondary roller for fountain solution patterning of a latent image for transfer to an inking blanket.

BACKGROUND

Offset lithography is a common method of printing today. For the purpose hereof, the terms "printing" and "marking" are interchangeable. In a typical lithographic process, a printing plate, which may be a flat plate, the surface of a cylinder, belt and the like, is formed to have image regions formed of hydrophobic and oleophilic material, and non-image regions formed of a hydrophilic material. The image regions are regions corresponding to areas on a final print (i.e., the target substrate) that are occupied by a printing or a marking material such as ink, whereas the non-image regions are regions corresponding to areas on the final print that are not occupied by the marking material.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778.

A variable data lithography (also referred to as digital lithography) printing process usually begins with a fountain solution used to dampen a silicone imaging plate or blanket on an imaging drum. The fountain solution forms a film on the silicone plate that is on the order of about one (1) micron thick. The drum rotates to an exposure station where a high-power laser imager is used to remove the fountain solution at locations where image pixels are to be formed. This forms a fountain solution based latent image. The drum then further rotates to an inking station where lithographic-like ink is brought into contact with the fountain solution based latent image and ink transfers into places where the laser has removed the fountain solution. The ink is usually hydrophobic for better adhesion on the plate and substrate. An ultraviolet (UV) light may be applied so that photo-initiators in the ink may partially cure the ink to prepare it for high efficiency transfer to a print media such as paper. The drum then rotates to a transfer station where the ink is transferred to a print substrate such as paper. The silicone plate is compliant, so an offset blanket is not needed to aid transfer. UV light may be applied to the paper with ink to fully cure the ink on the paper. The ink is on the order of one (1) micron pile height on the paper.

The inventors found challenges with the above discussed offset digital lithography approaches. The formation of the image on the printing plate/blanket is usually done with imaging modules each using a linear output high power infrared (IR) laser to illuminate a digital light projector (DLP) multi-mirror array, also referred to as the "DMD" (Digital Micromirror Device). The laser provides constant illumination to the mirror array. The mirror array deflects individual mirrors to form the pixels on the image plane to pixel-wise evaporate the fountain solution on the silicone plate to create the fountain solution latent image. Also, durability and manufacturability of the imaging blanket is compromised due to distinct surface energy requirements and thermal absorption properties for fountain solution deposition, pixel-wise fountain solution evaporation, ink deposition, ink-transfer, and compliance metrics for inking, and ink-transfer steps.

Due to the need to evaporate the fountain solution to form the latent image, power consumption of the laser accounts for the majority of total power consumption of the whole system. The laser power that is required to create the digital pattern on the imaging drum via thermal evaporation of the fountain solution to create a latent image is particularly demanding (30 mW per 20 um pixel, ~500 W in total). The high-power laser module adds a significant cost to the system; it also limits the achievable print speed to about five meters per second (5 m/s) and may compromise the lifetime of the exposed components (e.g., micro-mirror array, imaging blanket, plate, or drum).

For the reasons stated above, and for other reasons which will become apparent to those skilled in the art upon reading and understanding the present specification, it would be beneficial to increase speed and lower power consumption in variable data lithography system.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing an ink-based image forming device having a rotatable inking blanket configured to accept a patterned fountain solution latent image and transfer an ink image based on the patterned fountain solution latent image. The ink-based image forming device includes a secondary roller, a fountain solution deposition system and a pixelated heat source. The secondary roller has a reimageable surface layer in rolling contact with the rotatable inking blanket at a nip therebetween. The fountain solution deposition system is adjacent the secondary roller and is to deposit a layer of fountain solution onto the reimageable surface layer. The pixelated heat source is adjacent the secondary roller and downstream the fountain solution deposition system. The pixelated heat source is configured to vaporize the layer of fountain solution in an image-wise manner from the reimageable surface layer and form a patterned fountain solution latent image on the reimageable surface layer. The secondary roller transfers at least a portion of the patterned fountain solution latent image to the rotatable inking blanket at the nip.

According to aspects illustrated herein, an exemplary method of transferring a patterned fountain solution latent image to a rotatable inking blanket of an ink-based image forming device, the rotatable inking blanket configured to accept the patterned fountain solution latent image and transfer an ink image based on the patterned fountain solution latent image is discussed. The method includes depositing a fountain solution layer onto a reimageable surface layer of a secondary roller by a fountain solution deposition system, the secondary roller being in rolling contact with the rotatable inking blanket at a nip therebetween, vaporizing the layer of fountain solution in an image-wise manner from the reimageable surface layer via a pixelated heat source adjacent the secondary roller and downstream the fountain solution deposition system, the vaporizing forming a patterned fountain solution latent image on the reimageable surface layer, and transferring at least a portion of the patterned fountain solution latent image from the reimageable surface layer of the secondary roller to the rotatable inking blanket at the nip.

According to aspects described herein, an ink-based image forming device having a rotatable inking blanket configured to accept a patterned fountain solution latent image and transfer an ink image based on the patterned fountain solution latent image is discussed. The ink-based image forming device includes a secondary roller, a fountain solution deposition system and a pixelated heat source. The secondary roller has a reimageable surface layer in rolling contact with the rotatable inking blanket at a nip therebetween, the reimageable surface layer having a textured surface with pixel sized lands surrounded by sharp edges between the lands, the textured surface designed to reduce lateral spreading of fountain solution via contact pinning of the fountain solution on the textured surface. The fountain solution deposition system is adjacent the secondary roller, the fountain solution deposition system configured to deposit a layer of fountain solution onto the reimageable surface layer, the fountain solution deposition system including a vapor development device having a manifold with walls defining a chamber adjacent the reimageable surface layer for transfer of fountain solution vapor into the chamber and condensation of the fountain solution vapor onto the reimageable surface layer as the layer of fountain solution. The pixelated heat source is adjacent the secondary roller and downstream the fountain solution deposition system, the pixelated heat source configured to vaporize the layer of fountain solution in an image-wise manner from the reimageable surface layer and form a patterned fountain solution latent image on the reimageable surface layer. The secondary roller transfers at least a portion of the patterned fountain solution latent image to the rotatable inking blanket at the nip.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION OF THE INVENTION

Figure 1:
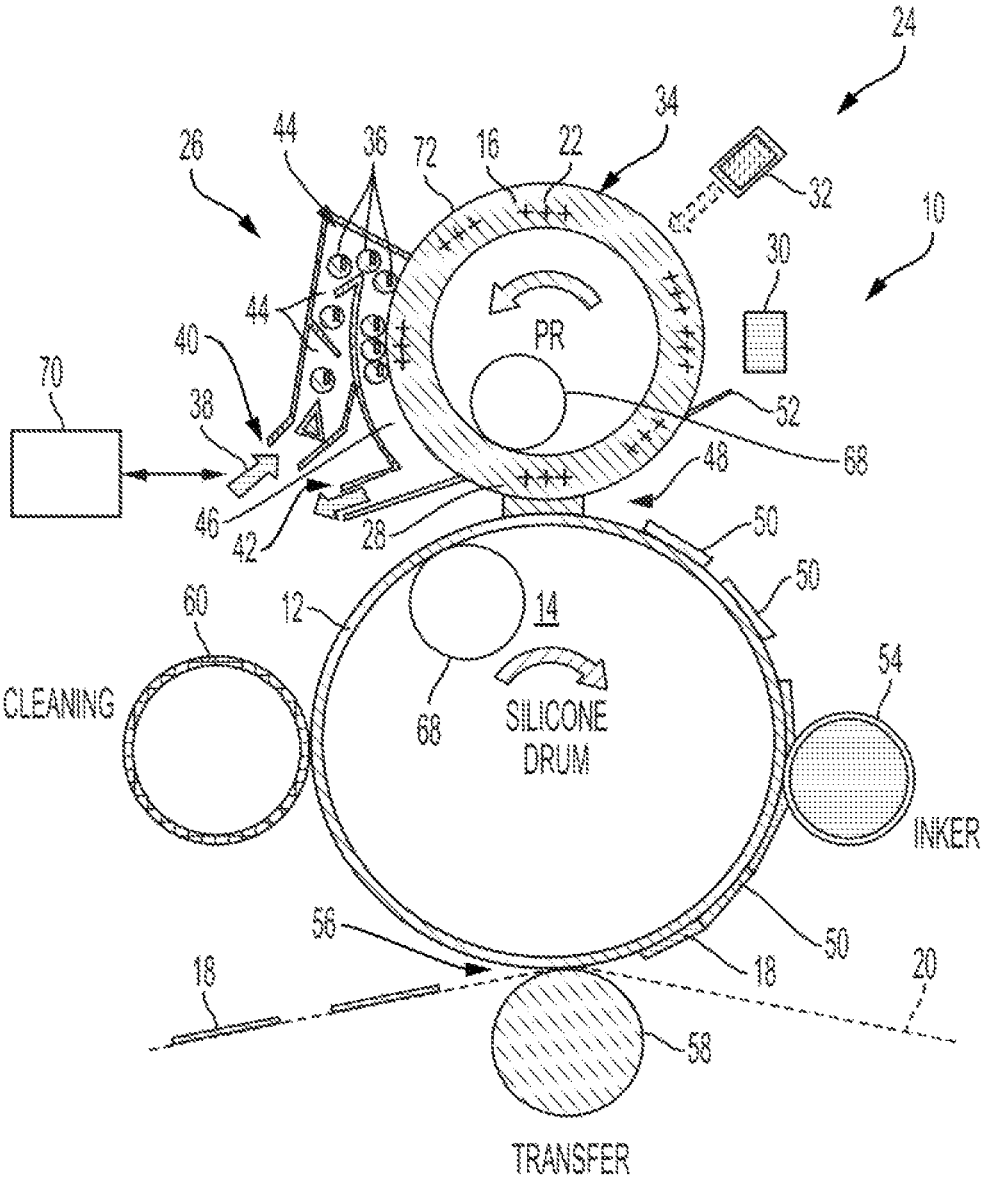
FIG. 1 illustrates a diagram of an ink-based digital printing system having a secondary roller with a textured outer surface in accordance with examples.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "image forming device", "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "fountain solution" or "dampening fluid" refers to dampening fluid that may coat or cover a surface of a structure (e.g., imaging member, transfer roll) of an image forming device to affect connection of a marking material (e.g., ink, toner, pigmented or dyed particles or fluid) to the surface. The fountain solution may include water optionally with small amounts of additives (e.g., isopropyl alcohol, ethanol) added to reduce surface tension as well as to lower evaporation energy necessary to support subsequent laser patterning. Low surface energy solvents, for example volatile silicone oils, can also serve as fountain solutions. Fountain solutions may also include wetting surfactants, such as silicone glycol copolymers. The fountain solution may be non-aqueous including, for example, silicone fluids (such as D3, D4, D5, OS10, OS20, OS30 and the like), Isopar fluids, and polyfluorinated ether or fluorinated silicone fluid.

The term "aerosol" refers to a suspension of solid and/or liquid particles in a gas. An aerosol may include both the particles and the suspending gas, which may be air, another gas or mixture thereof. The solids and/or liquid particles are sufficiently large for sedimentation, for example, as fountain solution on an imaging member surface. For example, solid or liquid particles may be greater than 0.1 micron, less than 5 microns, between about 0.5 and 2 microns and about 1 micron in diameter.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather are used to distinguish one element from another. The terms "a" and "an" herein do not denote a limitation of quantity, but rather denote the presence of at least one of the referenced items.

One way to overcome issues with prior art digital imaging systems as discussed above is to decouple the fountain solution patterning step from the inking, and transfer steps. The digital patterning of fountain solution may be achieved on a secondary roller. Subsequently, the fountain solution image may be transferred onto the inking blanket/ main drum for inking and ink transfer to paper or other print substrate. Benefits include relaxing prior digital imaging system blanket requirements, since the thermal absorption properties (achieved through carbon black loaded fluorosilicone) are no longer required.

FIG. 1 depicts an exemplary ink-based digital image forming apparatus 10 for variable data lithography including fog development of a charged fountain solution aerosol that forms a latent digital image created electrographically. The latent digital image is transferred to an inking blanket 12 of a transfer member 14 (e.g., roller, cylinder, drum) downstream an imaging member 16 for subsequent printing of an associated ink image 18 onto a print substrate 20. The imaging member 16 shown in FIG. 1 is a drum, but this exemplary depiction should not be read in a manner that precludes the imaging member 16 being a blanket, a belt, or of another known configuration. The image forming apparatus 10 includes the rotatable imaging member 16 as a secondary roller 88 having an arbitrarily reimageable surface 22 as different images can be created on the surface layer. In examples, the surface 22 is a charge-retentive surface such as but not limited to a photoreceptor surface or a dielectric surface. The reimageable charge-retentive surface 22 may be part of the drum or formed over a structural mounting layer that may be, for example, a cylindrical core, or one or more structural layers over a cylindrical core. The reimageable charge-retentive surface may be formed of a relatively thin layer over the mounting layer, a thickness of the relatively thin layer being selected to balance charge retaining performance, durability and manufacturability. The imaging member 16 is surrounded by an imaging station 24 configured to form an electrostatic charged pattern of a latent image on the imaging member surface 22, and an aerosol development device 26 that provides a fog of charged fountain solution aerosol particles that are attracted to the electrostatic charged pattern.

According to examples, fountain solution latent images 28 are created (e.g., xerographically, ionographically) on imaging member 16 and transferred to the inking blanket 12 for further processing. At the imaging station 24, a charging device 30 charges the imaging member surface 22, for example by corona discharge from a high voltage power source via a conductor of the charging device adjacent the charge-retentive imaging member surface 22. In electrography or xerography an imager 32 having a low power light source (e.g., a laser with a conventional ROS scanner, LED bar) selectively discharges select portions or pixels of the surface 22 according to image data to generate an electrostatic charged pattern 34 disposed on the surface of the imaging member 20. In ionography the imager 32 includes an image projection head for projecting ion beams, i.e., ions of a given polarity, onto the charge-retentive surface 22 after the surface is charged by the charging device 30. The surface 22 shown could be a photoreceptor, but when the application is ionographically created, an insulating surface could be used to create the charge image.

The aerosol development device 26 presents a charged patterned uniform layer of fountain solution (e.g., silicone fluids, such as D4, D5, Isopar G, Isopar H, Dowsil OS20, Dowsil OS30, L5; water/IPA mixtures, hydrophilic fluids, and mixtures thereof) aerosol particles 36 in solid or liquid particle form onto the surface 22 of the imaging member 16. The fountain solution aerosol particles 36 are configured to adhere to portions of the imaging member surface 22 according to the electrostatic charged pattern 34 developed thereon by imager 32. In examples, charged fountain solution aerosol particles 36 of opposite polarity of the imaging member surface 22 are deposited onto the electrostatic charged pattern 34, forming a fountain solution latent image 28 on the imaging member surface. In other examples, charged fountain solution aerosol particles 36 of the same polarity as the imaging member surface 22 would be deposited on the neutral pixels thereof.

The aerosol development device 26 atomizes and charges fountain solution 38 into charged fountain solution aerosol particles 36 that enter an inlet port 40. In examples, a pump may supply fountain solution from a container housing the fountain solution to an aerosol generator (e.g., a nebulizer) at a steady, controlled rate. The fountain solution may contain charge control agents (e.g., surfactants, polymer solution, salts), to assist particle charging, as well understood by a skilled artisan. The aerosol development device 26 further includes a manifold having walls 62 defining a chamber 44 and a radially enlarged region 46 near the imaging member surface 22 where a fog of charged fountain solution aerosol particles 36 may carry the atomized fountain solution to the electrostatic charged pattern 34 on the surface of imaging member 16.

A carrier gas such as nitrogen, added in a predetermined amount, may be introduced into the developer unit chamber 44 via inlet port 40 to carry the atomized fountain solution aerosol particles 36 to the surface 22 of imaging member 16 as a gas mixture, where they may be attracted to the electrostatic charged pattern 34 and bond to the charge-retentive reimageable surface 22 and form a fountain solution latent image 28. The gas mixture transporting the atomized fountain solution aerosol particles includes the carrier gas and a controlled partial pressure of fountain solution. This partial pressure of fountain solution may solely originate from evaporated fountain solution or a controlled additional vaporized fountain solution. An increase in the partial pressure of the fountain solution will slow down the evaporation from the fountain solution droplets. The partial pressure may be modified, for example, by the controller adding vaporized fountain solution to the gas mixture, as well understood by a skilled artisan.

The surface charge density (created by charging device 30) of the latent image attracts a volume of fountain solution aerosol particles 36 until the surface charge is optionally neutralized or partially neutralized by the fog charged aerosol. Adhesion forces with the imaging member 16 and each other will cause the aerosol particles to remain on the surface 22 of the imaging member.

Aerosol particles 36 do not bond to the surface 22 of imaging member 16 where no latent image charge resides. The aerosol particles 36 can also be electrostatically repelled from uncharged regions of the electrostatic charged pattern 34, for example, via voltage applied to walls of the development device 26. Aerosol particles 36 that do not bond to the imaging member surface 22 may exit the developer unit 20 via outlet port 42 and flow back to the fountain solution container. A vapor vacuum or air knife (not shown) may be positioned adjacent the downstream side of the radially enlarged region 46 near the outlet port 42 to collect unattached aerosol particles and thus avoid leakage of fountain solution into the environment. Reclaimed fountain solution particles can also be condensed and filtered as needed for reuse as understood by a skilled artisan to help minimize the overall use of fountain solution by the image forming device 10.

The transfer member 14 may be configured to form a fountain solution image transfer nip 48 with the imaging member 16. A fountain solution image produced by the developer unit 26 and imaging station 24 on the surface 22 of the imaging member 16 is transferred to the inking blanket 12 of the transfer member 14 under pressure at the loading nip 48. In particular, a light pressure (e.g., a few pounds, greater than 0.1 lbs., less than 10 lbs., about 1-4 lbs.) may be applied between the surface of the inking blanket 12 and the imaging member surface 22. At the fountain solution transfer nip 48, the fountain solution latent image 28 splits as it leaves the nip, and transfers a split layer of the fountain solution latent image, referred to as the transferred fountain solution latent image 50, to the transfer member surface (i.e., inking blanket 12). The amount of fountain solution transferred may be adjusted by contact pressure adjustments of nip 48. For example, a split fountain solution latent image 50 of about one (1) micrometer or less may be transferred to the inking blanket surface. Like the imaging member 16, the transfer member 14 may be electrically biased to enhance loading of the dampening fluid latent image at the loading nip 48.

After transfer of the fountain solution latent image from the imaging member 16, the imaging member 16 may be cleaned in preparation for a new cycle by removing dampening fluid and solid particles from the surface at a cleaning station 52. Various methods for cleaning the imaging member surface 22 may be used, for example an air knife and/or sponge, as well understood by a skilled artisan.

After the fountain solution latent image 50 is transferred to the transfer member 14, ink from an inker 54 is applied to the inking blanket 12 to form an ink pattern or image 18. The inker 54 is positioned downstream fountain solution transfer nip 48 to apply a uniform layer of ink over the transferred fountain solution latent image 50 and the inking blanket 12. While not being limited to a particular theory, the ink pattern or image 18 may be a negative of or may correspond to the fountain solution pattern. For example, the inker 54 may deposit the ink to the evaporated pattern representing the imaged portions of the reimageable surface 26, while ink deposited on the unformatted portions of the fountain solution will not adhere based on a hydrophobic and/or oleophobic nature of those portions. The ink image 18 may be transferred to print media or substrate 20 at an ink image transfer nip 56 formed by the transfer member 14 and a substrate transport roll 58. The substrate transport roll 58 may urge the print substrate 20 against the transfer member surface, or inking blanket 12, to facilitate contact transfer of the ink image 18 from the transfer member 14 to the print substrate.

After transfer of the ink image 18 from the transfer member 14 to the print media 20, residual ink may be removed by a cleaning device 60. This residual ink removal is most preferably undertaken without scraping or wearing the imageable surface of the imaging blanket 12. Removal of such remaining fluid residue may be accomplished through use of some form of cleaning device 60 adjacent the imaging blanket 12 between the ink image transfer nip 56 and the fountain solution transfer nip 48. Such a cleaning device 20 may include at least a first cleaning member such as a sticky or tacky roller in physical contact with the imaging blanket surface, with the sticky or tacky roller removing residual fluid materials (e.g., ink, fountain solution) from the surface. The sticky or tacky roller may then be brought into contact with a smooth roller (not shown) to which the residual fluids may be transferred from the sticky or tacky member, the fluids being subsequently stripped from the smooth roller by, for example, a doctor blade or other like device and collected as waste.

It is understood that the cleaning device 60 is one of numerous types of cleaning devices and that other cleaning devices designed to remove residual ink/fountain solution from the surface of imaging blanket 12 are considered within the scope of the embodiments. For example, the cleaning device could include at least one roller, brush, web, belt, tacky roller, buffing wheel, etc., as well understood by a skilled artisan. It is also understood that the cleaning device 60 may be more sophisticated or aggressive at removing residual fluids from imaging blanket 12 that the cleaning station 52 is at removing fountain solution from the surface 22 of the imaging member 16. Cleaning station 52 is not concerned with removing residual ink, and merely is designed to remove fountain solution and associated contaminates from the surface 22.

The exemplary ink-based digital image forming devices and operations thereof may be controlled by a controller 70 in communication with the image forming devices and parts thereof. For example, the controller 70 may control the imaging station 24 to create electrostatic charged patterns of latent images on the imaging member surface 22. Further, the controller 70 may control the aerosol development device 26 or other aerosol development devices discussed in greater detail below to provides the fog of charged fountain solution aerosol particles that are attracted to the electrostatic charged pattern. The controller 70 may be embodied within devices such as a desktop computer, a laptop computer, a handheld computer, an embedded processor, a handheld communication device, or another type of computing device, or the like. The controller 70 may include an operating interface, memory, at least one processor, input/output devices, a display, external communication interfaces, an image forming control device, and a bus. The bus may permit communication and transfer of signals among the components of the controller 70 or computing device, as readily understood by a skilled artisan.

It is understood that the aerosol development device 26 is one of numerous types of fountain solution delivery devices that present a charged patterned layer of fountain solution particles in liquid or solid form to a secondary roller 88 (e.g., imaging member 16, intermediate roller) surface that are considered within the scope of the embodiments. Other examples are disclosed in U.S. patent application Ser. Nos. 17/152,630; 17/152,597; 17/152,538; 17/152,574; 17/384,312, and 17/546,108. Subsequently, in these examples the fountain solution image may be transferred onto the inking blanket/main drum for inking and ink transfer to paper or other print substrate.

Figure 2:
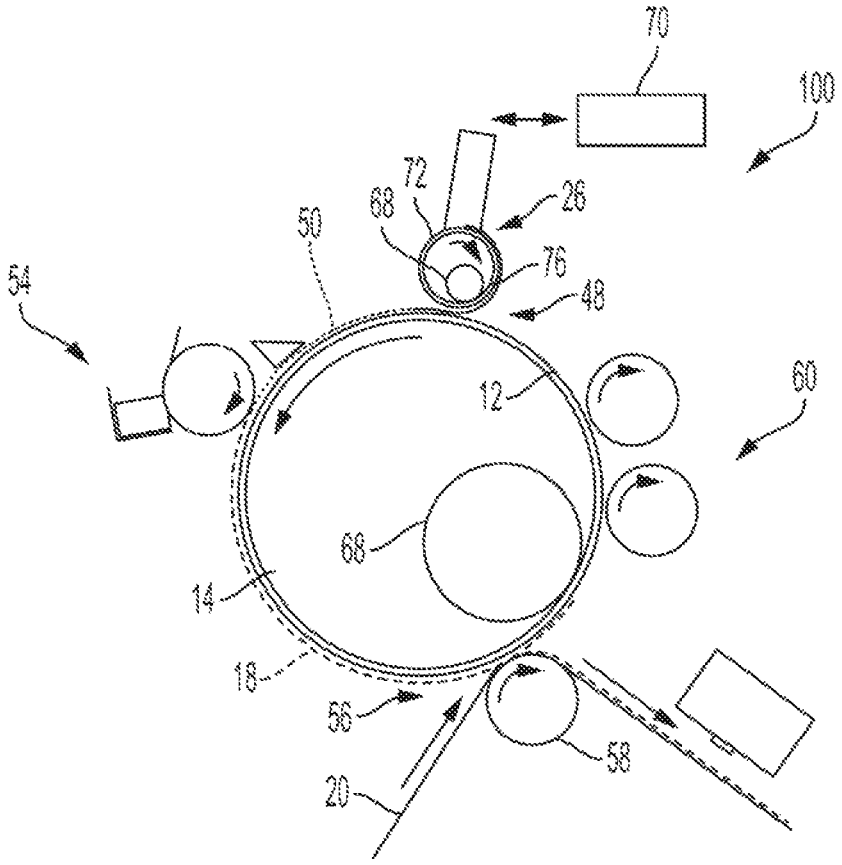
FIG. 2 is a diagram of another ink-based digital printing system having a secondary roller with a textured outer surface in accordance with examples.

While the examples describe fountain solution deposition where the fountain solution is configured to adhere to portions of the imaging member surface 22 according to the electrostatic charged pattern 34 developed thereon by imager 32 prior to transfer to the inking blanket, it is also understood that patterning of the fountain solution on the secondary roller may be achieved through approaches other than evaporation by laser light. For example, U.S. patent application Ser. No. 17/494,208 discloses an example where the secondary roller (e.g., intermediate roller) includes a flexible TFT array/drum and each individually addressable TFT pixel may generate heat to locally evaporate the fountain solution over the respective pixel and thus create a fountain solution image that is subsequently transferred to the inking blanket. In this later example, the secondary roller surface is not required to be charge-retentive, but is still reimageable. An example may be seen in FIG. 2, with the secondary roller 88 being a patterned intermediate roller 72 having a textured outer surface 74 layer and a flexible TFT array 78 under the textured outer surface layer in accordance with embodiments as discussed in greater detail below. Accordingly, the secondary roller is a fountain solution imaging member having a reimageable surface layer that may be charge retentive and/or heat conductive.

Figure 3:
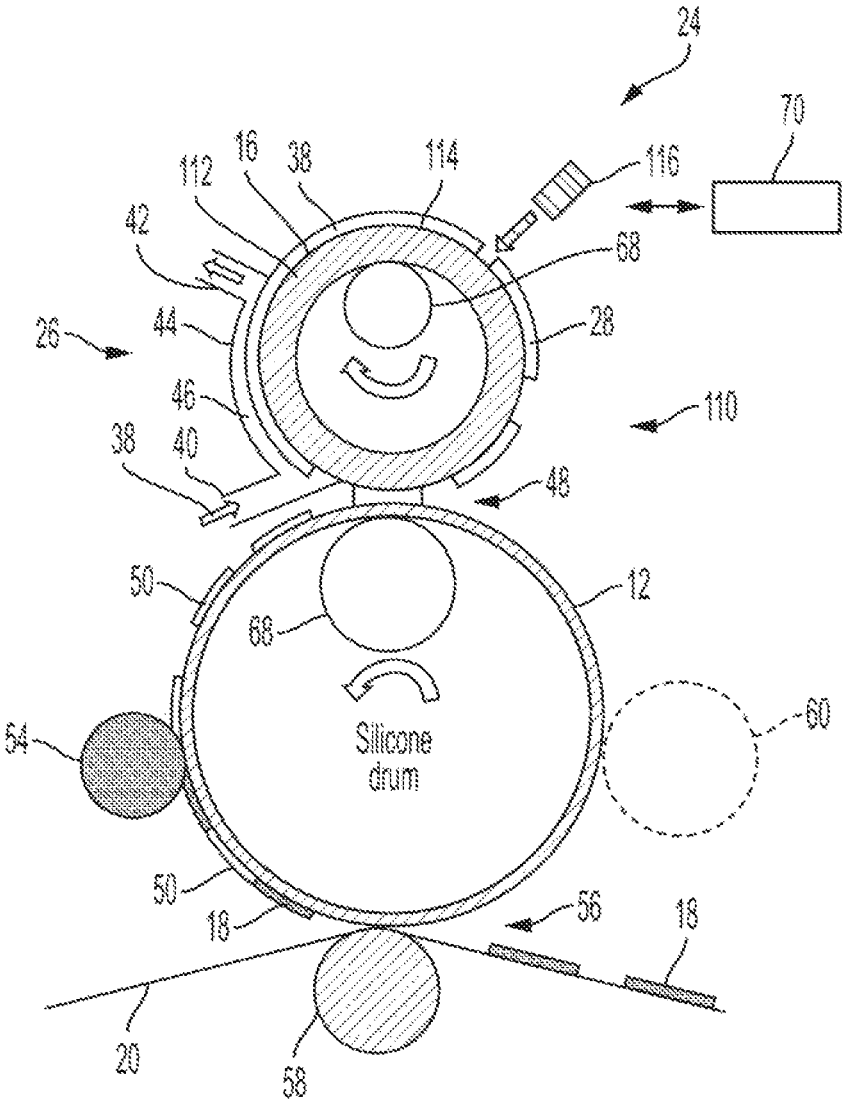
FIG. 3 is a diagram of yet another ink-based digital printing system having a secondary roller in accordance with examples.

The secondary roller may also be uniquely optimized for the high absorption of a pixelated optical heating source and the minimization of thermal conductance. FIG. 3 depicts an exemplary ink-based digital image forming apparatus 110 similar to the image forming devices 10 and 100 having an inking blanket 12 of a transfer member 14 (e.g., roller, cylinder, drum) for printing an ink image 18 onto a print substrate 20 as discussed above. The inking blanket 12 is downstream a secondary roller 112 that is a fountain solution imaging member 16 having a reimageable surface layer 114. The imaging member 16 shown in FIG. 3 is a drum, but this exemplary depiction should not be read in a manner that precludes the imaging member 16 being a blanket, a belt, or other imaging member configuration. Transferring fountain solution imaging the secondary roller 112 enables dramatic cost-down, speed-up and life extension for the inking blanket 12. Prior inked image transfer members integrated all operations on the single inking blanket material, requiring high optical absorption, minimal thermal conductance, rapid thermal cycling as well as strict control of surface energetics. Separating the actions of fountain solution image generation to the secondary roller 112, and inking/printing to the transfer member 14, each roller may use different surfaces for optimization of each roller.

While not being limited to a particular theory, the secondary roller 112 may have a reimageable surface layer 114 that is optimized for the high absorption of a pixelated optical heating source and the minimization of thermal conductance while having the very low surface energy, as described in greater detail below for all the secondary rollers, to minimally, but sufficiently, bind fountain solution to patterned pixels and enhance forward transfer to the inking blanket 12. This separation of latent imaging and ink transfer allows the inking blanket 12 to be free of carbon black loading. Thus, because the compliant inking blanket 12 (e.g., silicone) necessarily has a low durometer, cyclic deformation of the inking blanket at transfer nips 48, 56 no longer creates abrasive forces around the loaded particles. Furthermore, extreme thermal cycling also degrades compliant imaging blanket lifetime. However, the secondary roller 112 has a hard surface 114 that make optical and/or thermal properties easier to optimize, as will be discussed in greater detail below.

Referring to FIG. 3, a layer of fountain solution 38 may be deposited from a fountain solution vapor source onto the surface 114 of the secondary roller 112 in liquid or vapor form by a fountain solution deposition system, which is shown as a vapor development device 26. The vapor development device 26 includes a manifold having walls defining a chamber 44 and a radially enlarged region 46 near the imaging member surface 114 where a fog of fountain solution 38 may enter inlet 40 for condensation on the surface opposite the manifold walls as a layer of fountain solution. Excess vapor that does not condense on the imaging member surface 114 may exit the manifold at outlet 42, and may be recycled to the vapor source for redeposition. The dampening system may include a series of rollers, sprays or a vaporizer (not shown) for uniformly wetting the reimageable surface 114 with a uniform layer of fountain solution with the thickness of the layer being controlled.

In a digital evaporation step, particular portions of the fountain solution layer deposited onto the surface 114 of the secondary roller 112 may be evaporated by a digital evaporation system. For example, portions of the fountain solution layer may be vaporized or evaporated away by an optical imaging station 24 having a pixelated heat source 116 (e.g., LED bar, laser diode raster output scanner, thermal print head, etc.) that patterns the fluid solution layer to form a latent image 28. The secondary roller surface 114 efficiently absorbs the heat and locally vaporizes the fluid layer in an image-wise manner resulting in the latent image 28 of remaining fountain solution 38. At the nip 48 formed by the secondary roller 112 and imaging blanket 12 the fountain solution splits or completely forward transfers to the imaging blanket, forming a fountain solution image 50 on the imaging blanket surface. The rest of the ink printing proceeds as discussed above during the description of the digital image forming device depicted in FIG. 1. For clarity, it should be pointed out that the secondary rollers (e.g., imaging member 16) and inking blankets 12 are shown in FIGS. 1 and 3 rotating in opposite directions due to the opposite side views of the image forming devices 10, 110.

Figure 11:
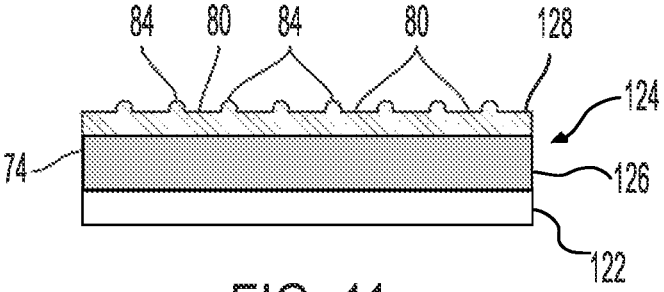
FIG. 11 is a side view in cross of the textured outer surface layer of FIG. 10.

The secondary roller fountain solution imaging member 16 may have a surface layer 114 that is textured around a solid core 122 (FIG. 11). The imaging member 16 may also have a compliant, or textured compliant surface layer 114 having a thickness or depth (e.g., less than 100 microns, less than 50 microns, about 5-20 microns) wrapped around the solid core. In examples, the compliant layer may surround the core under a textured surface layer as will be discussed in greater detail below. The core may be solid, rigid, hollow or some combination thereof, with a hollowed core configured to allow fluid therein. In fact, all of the secondary rollers and inked image transfer members 14 include outer layers designed for optimal latent image forming or ink imaging and transfer. The secondary rollers and inked image transfer members may further include a core surrounded by the outer layers that may mb solid, rigid, hollow or some combination thereof, with a hollowed core configured to allow fluid therein, as will be discussed in greater detail below.

As discussed above, attributes of the secondary roller 112 may be important for pixelated fountain solution imaging thereon, including high optical to thermal conversion efficiency in a very thin layer 32 (e.g., less than 5 μm, between about 5 nm and 200 nm, about 10 nm to 100 nm) of fountain solution, minimal heat conduction radially towards the center of the secondary roller, and high oleophobicity of the reimageable surface 114. High optical absorption may be provided by adding a surface layer material that is strongly absorbing at the illumination wavelength, for example, carbon black or carbon nanotube loading of a fluoro-silicone surface layer.

The reimageable surface may include a thermally insulating coating or layer 126 (FIG. 11). Further, a metal layer 128 (FIG. 11) may be deposited over, under or into the thermally insulating coating or layer. Nano-particle filler of refractory metal carbides such as TiC, ZrC, WC, etc. in a fluoro-silicone surface layer may be highly optically absorbing yet may have better cohesion with the fluoro-silicone matrix than carbon filler. Intrinsically absorbing, controlled porosity metal oxides such as aluminum oxide on aluminum, or chromium oxide on chrome can be formed by anodization. The metal layer 128 may be an alloy with high impurity concentration as understood by a skilled artisan. Diamond-like carbon layers deposited by physical vapor deposition may also produce a very robust, highly absorbing surface layer 114. In certain examples, a metal layer may be deposited onto the thermally insulating secondary roller cylinder, and then thermally oxidized for a fixed time/temperature or oxide deposited to a desired thickness. The oxide layer thickness may be chosen to provide minimal reflectance at the incident wavelength, thereby producing maximum absorption in the metal base layer.

To minimize heat conduction or heat loss radially towards the center of the secondary roller, an insulating layer may be provided between an optical absorber layer 124 and the roller core. In examples, the optical absorber layer 124 includes the thermally insulating layer 126 and the metal layer 128 (FIG. 11). Exemplary insulating layers may include alumina, polymers (e.g., polycarbonate, silicone, glass) and other material layers readily understood by a skilled artisan.

Approaches for fountain solution binding and forward transfer of very-high resolution latent images to the inking blanket are described in greater detail below. In examples, a super-oleophobic coating on the surface layer 114, that may also be super-hydrophobic when more ionic fountain solutions are used, may be provided for reduced lateral spreading of fountain solution. Electro-chemically formed layers may have controlled porosity and provide lower adhesion of the fountain solution and lower thermal conductivity of the oxidized layer for beneficial pixel area fountain solution contact line pinning. The absorbing surface coating layer may be segmented laterally on a scale smaller than a pixel to further help minimize lateral heat and fountain solution flow.

As noted above, exemplary secondary roller configurations for creating the fountain solution image are followed by splitting the fountain solution latent image from the secondary roller onto the inking blanket/main drum. To achieve a desired very high-resolution (e.g., 1200-dpi, over 900-dpi) print with these secondary roller configurations, an equivalent very high-resolution fountain solution image should be transferred from the secondary roller (e.g., imaging member 16, intermediate roller) onto the main drum (e.g., inking blanket 12).

For digital imaging print processes described in examples, the fountain solution thickness on the inking blanket/main drum after splitting needs to be less than about 100 nm, 20 nm-70 nm, 35 nm-65 nm, or about 50 nm. Fountain solutions discussed herein, including Octamethylcyclotetrasiloxane D4, have a melting point (e.g., less than 25° C., between 15° C. and 20° C., about 17° C.-18° C.), and thus the secondary roller needs to be operated at close to the melting point at the transfer nip 48 (pressure at the transfer nip might locally increase temperatures) to allow the transfer of the fountain solution image onto the main drum. Depending on the adhesion of the fountain solution to the secondary roller, the fountain solution might split onto the inking blanket, or transfer entirely to the inking blanket.

The inventors have found that high-resolution offset digital lithography prints (e.g., above about 600 dpi) could previously be achieved only after cooling the inking blanket to about the freezing/melting temperature of the fountain solution, for example about 14° C.-15° C. This allowed pinning of the fountain solution to the inking blanket with a contact angle of about 29°. However, long-term print runs tend to heat the inking blanket to above 15° C., which results in poorer print quality and, lower-resolution prints. For example, examining contact angles of fountain solution on amorphous silicon substrates, an inking blanket, and an organic photoreceptor drum (OPC) at room temperatures about 0.17° C.-0.19° C. (i.e., 60 nm/px) result in a lateral resolution limit of the fountain solution image of ~2-3 px on the secondary roller and contact angles of about 17° C.-19° C. In other words, for a smooth imaging member, fountain solution deposited or imaged to cover a single pixel (e.g., about 20 μm for 1200 dpi-about 28 μm for 900 dpi) tends to spread out over 2-3 pixels. After splitting, the same lateral resolution limit applies to the fountain solution image on the main drum inking blanket and resulted in printed images of 400-600 dpi. A contact angle is the angle at which a liquid interface meets a solid interface. The contact angle is a criterion of surface interfacial energy, and may be used to determine wettability of a surface.

To help increase the contact angle of fountain solution on the secondary rollers 72, 112 and the inking blankets 12, their surfaces may be cooled internally (e.g., with chilled fluid via a central drum chiller 68 refrigerant line that cools the imaging/transfer member drum) or externally (e.g., via a surface chiller roll (not shown)) to about the freezing/melting temperature of the fountain solution (e.g., about 14° C.-15° C.). Such a freezing/melting temperature may make the fountain solution appear in a near frozen or slurry state and minimize fountain solution spreading and wetting between pixel areas of the outer surfaces post imaging and transfer to the inking blanket. The imaging member may be cooled according to a temperature setpoint of a drum chilling system including the central drum chillers 68 and/or surface chiller rolls. The temperature setpoint may be predetermined (e.g., about 14° C.-15° C.) or adjusted within a predetermined range as readily understood by a skilled artisan. In examples such as can be seen in FIGS. 1 and 3, the central drum chiller 68 in the inked image transfer member 14 may be positioned at or near the fountain solution latent image transfer nip 48 so the transfer member may be colder at the nip for latent image transfer and warmer near the inker 54 for ink transfer.

The central drum chiller 68 may include a housing (e.g., roller, duct) in contact with an inner wall of the imaging member and/or ink transfer member drum. The chiller is not limited to the size of the cylindrical housing shown in the figures, and may expand to even include the inner wall of the imaging member and/or ink transfer member drum. In other words, an exemplary central drum chiller 68 may expand to the imaging member 16 drum, which may then define the cylindrical housing of the chiller. The central drum chiller 68 may provide internal chilling or temperature control to the imaging member and/or transfer member drum via fluid circulated through the interior of the hollow chiller. The drum chilling system may pump and recirculate the fluid into and out of the chiller 68. The drum chilling system may also include a refrigeration system heat exchanger, and even a heating system as needed to remove or add heat, respectively, from the re-circulating fluid depending on the current fluid temperature and the temperature setpoint of the respective drum chilling system. Heat absorbed by the fluid while in contact with the inner surface of the hollow chiller 68 and the imaging member and/or ink transfer member drum may be removed by the drum chilling system. In examples where the imaging member drum inner wall includes the cylindrical chiller housing, chilled fluid internal to the hollow drum enables a longer dwell time to remove heat, since the chilled fluid may fill the inside of the drum and maximize a heat exchange contact area and heat removal from the surface.

In order to achieve 1200-dpi fountain solution images on the secondary roller before splitting the patterned fountain solution image onto the digital image forming device main drum inking blanket, it would be beneficial to increase (e.g., 1.5-2 fold) the contact angle of fountain solution to the secondary roller material to allow high-resolution printing. Aspects of the examples introduce a texture onto the reimageable surface layer 22 of the secondary roller and thereby form a textured outer surface 72 to achieve fountain solution contact angle pinning for generation of 1200-dpi fountain solution images on the secondary roller. The secondary roller (e.g., imaging member 16, intermediate roller) textured reimageable surface layer has a micro-structure for contact angle pinning to generate higher resolution fountain solution images on the surface layer of the secondary roller. Moreover, some examples include a super-oleophobic surface coating.

Figure 5:
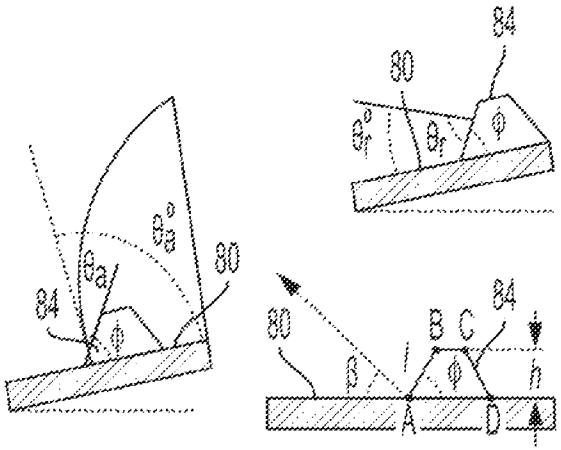
FIG. 5 is a side view in cross of an exemplary microstructures surface having top surface pixel lands with a microfabricated ring bump.
Figure 4:
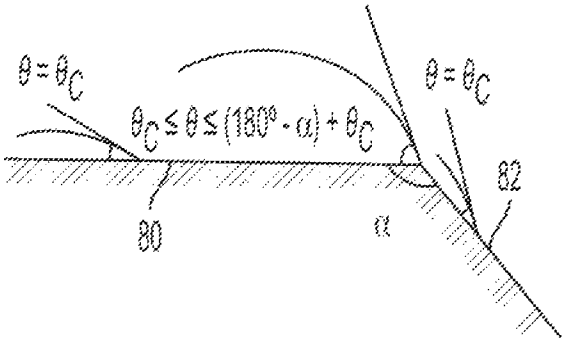
FIG. 4 is an exemplary side cross-sectional view showing part of a pixel land and sharp pit edge.

A texture may be applied to the surface of the secondary roller to achieve 1200-dpi fountain solution images. Such a micro-structured texture may increase the contact angle and show contact line pinning. The contact line, that is, the outer edge of a fountain solution drop where it intersects the solid secondary roller surface, may be pinned to a sharp edge between pixels (e.g., pixel size ~20 μm for 1200 dpi prints) or a microfabricated ring structure surrounding the pixel. In other words, an exemplary microstructure may include top surface pixel size lands with sharp pit edges between pixels. FIG. 4 illustrates a cross-sectional view example of a part of a pixel land 80 and sharp pit edge 82. FIG. 5 depicts an exemplary microstructure surface texture including top surface pixel lands 80 with a microfabricated ring structure (e.g., ring bump 84) surrounding a pixel. Micro-fabricated pillar structures as well as laser ablation may be used to change the surface roughness on the micron- to sub-micron scale and thus help to modify the surface wettability.

Surface texture may be generated via micro-fabrication or photolithography. Also, randomized structures could be introduced into the surface layer of the secondary roller, for example by particle bonding, sandblasting, or embossing processes, as well understood by a skilled artisan. The contact angle might also be increased by a low-surface energy coating (e.g., an amorphous fluoropolymer, a superoleophobic coating, an oleophobic coating having surface free energy less than about 72 mN/m or 30 mN/m or 20 mN/m). Such coatings could also be embossed with a micro-structure to help with contact line pinning. In certain embodiments only the lands may be coated with the low-surface energy coating.

Figure 7:
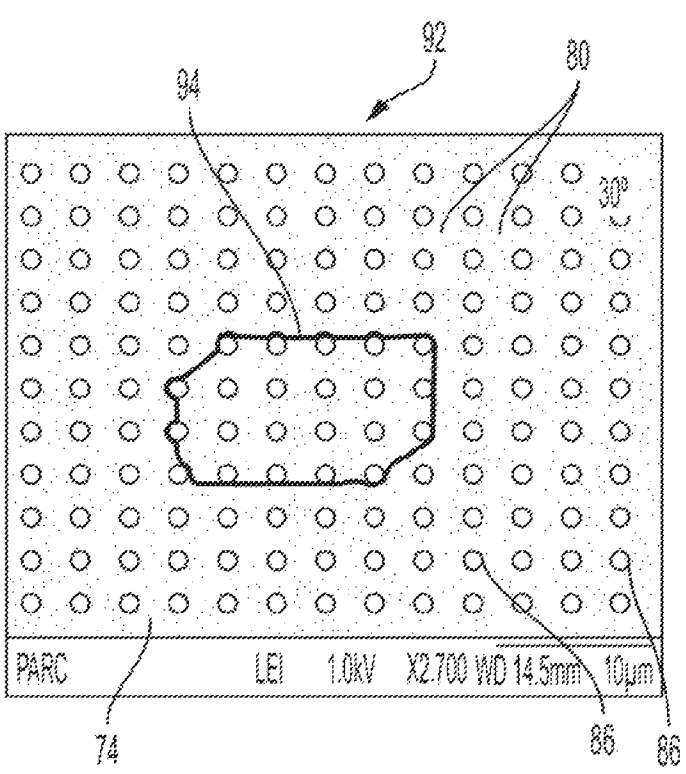
FIG. 7 is another top view of an exemplary secondary roller surface having a textured embossed outer surface in accordance with examples.
Figure 6:
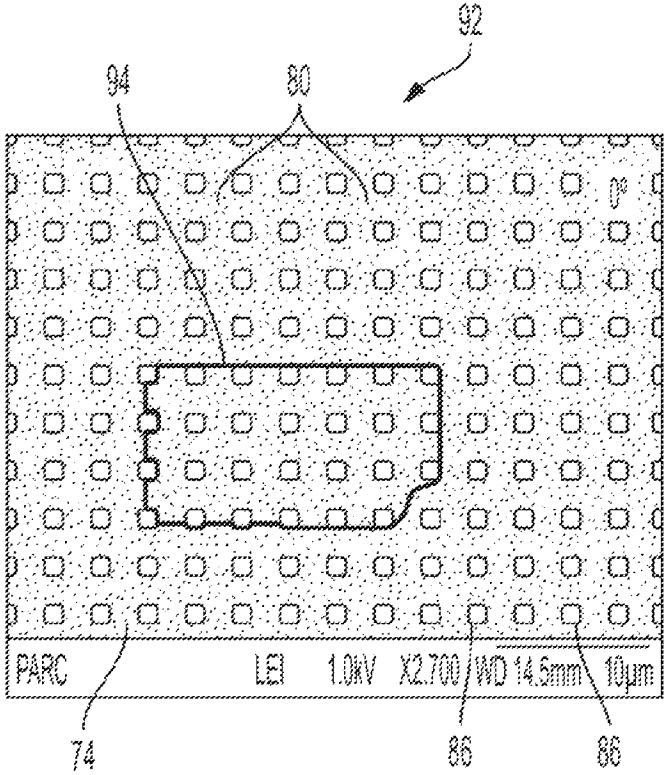
FIG. 6 is a top view of an exemplary secondary roller surface having a textured embossed outer surface in accordance with examples.

FIG. 6 depicts an exemplary secondary roller surface having a low-surface energy coating with a textured outer surface 74 embossed with a raised bump 86 (e.g., about a 3 μm pyramid) patterned structure 92 around pixel lands 80. FIG. 7 depicts another exemplary secondary roller surface with a textured outer surface 74 embossed with a raised bump 86 (e.g., about a 3 μm dome) patterned structure 92 around pixel lands 80. Both figures also show fountain solution 38 droplets deposited across pixel lands 80 with the low-surface energy coating and textured outer surface 74 contributing to pin the fountain solution along contact line 94. The textured outer surface 74 layer may also have a porous nanostructured surface (e.g., nano-posts, nanofibers) that provides omniphobicity and low surface energy, as readily understood by a skilled artisan. The nanostructured surface may also include micro sized bumps 86 over pixel land areas to minimize lateral fountain solution spreading.

Figure 8:
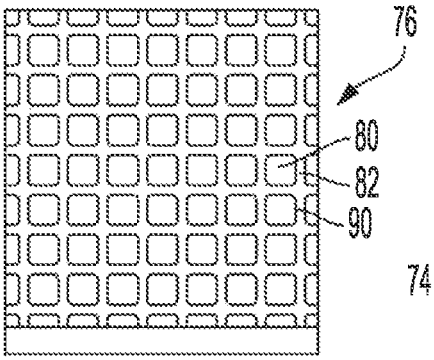
FIG. 8 is a top view of an exemplary textured outer surface layer having a micro-fabricated elevated checkerboard textured surface in accordance with examples.
Figure 9:
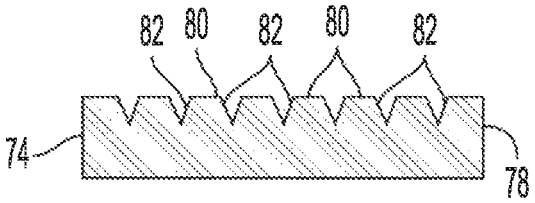
FIG. 9 is a side view in cross of the textured outer surface layer of FIG. 8.

Wear resistance and durability of the secondary roller is important for the digital image forming device 10 print process and needs to be considered in micro-structure surface approaches. FIGS. 8 and 9 depict sections of an exemplary textured outer surface layer having a micro-fabricated elevated checkerboard textured surface 78 in top and side cross-sectional view, respectively, with each pixel 90 having a square land 80 is surrounded by a sharp pit edge 82. In examples the waffled pits formed by the sharp pit edges 82 may be filled with a material having a surface energy even lower than or different than the surface energy of the lands to prevent undesired fountain solution spreading and wetting the filling material. The filler material may even elevate the surface around the lands to form ring bumps 84 or raised bumps 86. In certain examples the textured outer surface layer may have a micro-fabricated elevated textured secondary roller surface with circular, oval or polygonal lands surrounded by ring type bumps 84 or a ring-type sharp-edge structure, as understood by a skilled artisan.

In certain examples having an intermediate roller with of TFT patterning arrays as the secondary roller, surface textures as described above could be introduced in the surface layer via micro-fabrication or photolithography. In examples having an organic photoreceptor drum as the secondary roller, surface texture may be introduced into the top layer of the charge retentive reimageable surface of the secondary roller via, for example, low-energy surface coatings, lithography, embossing, and surface treatments such as laser ablation, polishing, or gentle sandblasting. The top layer of the charge retentive reimageable surface may include a protective overcoat layer that may increase wear resistance. The protective overcoat layer may include a mixture of hole transport molecules and benzoguanamine resin which form a cross-linked layer. For example, the formulation may be coated from a 7:3 mixture of IPA: 2-BuOH. The overcoat layer may also include micro sized bumps 86 to minimize lateral fountain solution spreading.

Figure 10:
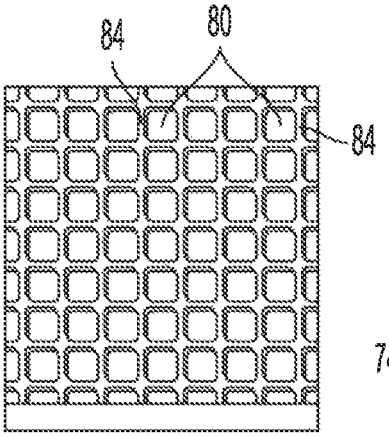
FIG. 10 is a top view of an exemplary textured outer surface layer having ring-type bumps surrounding pixel lands in accordance with examples.

Textured secondary roller surface layers as discussed herein, including textured pixelated surfaces having a sharp edge, pit, or indentation between single pixels, or having ring-type bumps 84 surrounding single pixel lands 80 (FIGS. 10-11), may also be used to pin the contact angle and prevent spreading of the fountain solution. Furthermore, a surface layer could be added to the secondary roller reimageable surface, such as a superoleophobic coating with a surface free energy less than the inking blanket. Additional examples of textured secondary roller surfaces may include polycrystalline materials with a high energy grain boundary introduced into the surface layer. The polycrystalline materials may be introduced into the surface layer by, for example, growing polycrystalline material onto the rotating secondary roller surface, cylinder, growing a thin film of polycrystalline material and using the film as a sleeve surface layer of the secondary roller or secondary belt to transfer the fountain solution latent image, or subtractive processing or machining to remove polycrystalline material from a larger block to form a roller or surface layer thereof, as readily understood by a skilled artisan. Fountain solution contact line pinning may also be achieved between oleophobic versus oleophilic grains, where, for example, the grains may define a boundary having grain boundary energy that may be tuned by adding impurities, strain or etching to the textured surface.

Claims directed to examples include a secondary roller for the digital imaging system to create a fountain solution image. The secondary roller in examples may include a textured surface layer for contact line pinning of fountain solution. The secondary roller in examples may include a sharp edge around single pixels, for example a ring-like structure surrounding the pixels, to provide fountain solution contact line pinning.

Claimed approaches to generate these micro-structures within the surface layer may comprise microfabrication, lithography, and/or embossing. Fountain solution contact line pinning may be achieved through surface roughening on nano- to few micron length-scale. Claimed approaches to enhance the charge retentive reimageable surface layer roughness may comprise microfabrication, lithography, embossing, sandblasting, bonding of nano- and micro-particles, laser ablation, and/or polishing. Fountain solution contact line pinning may be achieved by grain boundaries of polycrystalline materials comprising oleophobic and/or oleophilic grains. Claimed approaches to change the grain boundary of the polycrystalline surface layer of the examples may comprise the addition of impurities, strain/stresses, and/or etching. The surface layer of the secondary roller may include a super-oleophobic coating.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An ink-based image forming device having a rotatable inking blanket configured to accept a patterned fountain solution latent image and transfer an ink image based on the patterned fountain solution latent image, the ink-based image forming device comprising:

a secondary roller having a reimageable surface layer in rolling contact with the rotatable inking blanket at a nip therebetween;

a fountain solution deposition system adjacent the secondary roller, the fountain solution deposition system configured to deposit a layer of fountain solution onto the reimageable surface layer;

a pixelated heat source adjacent the secondary roller and downstream the fountain solution deposition system, the pixelated heat source configured to vaporize the layer of fountain solution in an image-wise manner from the reimageable surface layer and form a patterned fountain solution latent image on the reimageable surface layer, wherein the secondary roller transfers at least a portion of the patterned fountain solution latent image to the rotatable inking blanket at the nip.

2. The image forming device of claim 1, the reimageable surface layer having a textured surface designed to reduce lateral spreading of fountain solution via contact pinning of fountain solution on the textured surface.

3. The image forming device of claim 2, wherein the textured surface is a pixeled surface having pixel sized lands surrounded by sharp edges between the pixel sized lands.

4. The image forming device of claim 2, wherein the textured surface includes pixel sized lands having a width less than about 30 nm, the pixel sized lands being surrounded by sharp edges, the pixel sized lands having low-surface energy coating between the sharp edges that decreases the surface energy of the textured surface.

5. The image forming device of claim 2, wherein the textured surface includes a porous nanostructured omniphobic surface that decreases the surface energy of the textured surface.

6. The image forming device of claim 1, wherein the secondary roller includes a solid core, the reimageable surface layer including an optical absorber layer over the roller core.

7. The image forming device of claim 6, the optical absorber layer including a fluoro-silicone surface layer loaded with one of carbon black and carbon nanotube therein.

8. The image forming device of claim 6, the optical absorber layer including a fluoro-silicone surface layer loaded with a refractory metal carbide therein.

9. The image forming device of claim 6, the optical absorber layer including carbon layers deposited by physical vapor deposition.

10. The image forming device of claim 6, the optical absorber layer including a thermally insulating layer and a metal layer.

11. The image forming device of claim 10, wherein the metal layer includes one of aluminum oxide on aluminum, and chromium oxide on chrome.

12. The image forming device of claim 1, the secondary roller having a hollow core with a central drum chiller configured to lower the temperature of the patterned fountain solution latent image.

13. The image forming device of claim 1, wherein the secondary roller includes a solid core, a metal layer, and a thermally insulating layer positioned between the metal layer and the solid core.

14. The image forming device of claim 1, the fountain solution deposition system including a vapor development device having a manifold with walls defining a chamber adjacent the reimageable surface layer for transfer of fountain solution vapor into the chamber and condensation of the fountain solution vapor onto the reimageable surface layer as the layer of fountain solution.

15. The image forming device of claim 1, wherein the secondary roller includes a solid core, a metal layer, and a thermally insulating layer positioned between the metal layer and the solid core.

16. A method of transferring a patterned fountain solution latent image to a rotatable inking blanket of an ink-based image forming device, the rotatable inking blanket configured to accept the patterned fountain solution latent image and transfer an ink image based on the patterned fountain solution latent image, the method comprising:

depositing a fountain solution layer onto a reimageable surface layer of a secondary roller by a fountain solution deposition system, the secondary roller being in rolling contact with the rotatable inking blanket at a nip therebetween;

vaporizing the layer of fountain solution in an image-wise manner from the reimageable surface layer via a pixelated heat source adjacent the secondary roller and downstream the fountain solution deposition system, the vaporizing forming the patterned fountain solution latent image on the reimageable surface layer; and transferring at least a portion of the patterned fountain solution latent image from the reimageable surface layer of the secondary roller to the rotatable inking blanket at the nip.

17. The method of claim 16, the reimageable surface layer having a textured surface, the vaporizing contact pinning the fountain solution of the patterned fountain solution latent image between pixel land areas of the reimageable surface layer to avoid subsequent lateral spreading of the fountain solution on the textured surface.

18. The method of claim 16, the depositing the fountain solution layer onto the reimageable surface layer of the secondary roller by the fountain solution deposition system including transferring a fountain solution vapor into a chamber of a vapor development device manifold having walls defining the chamber adjacent the reimageable surface layer for condensation of the fountain solution vapor onto the reimageable surface layer as the layer of fountain solution.

19. An ink-based image forming device having a rotatable inking blanket configured to accept a patterned fountain solution latent image and transfer an ink image based on the patterned fountain solution latent image, the ink-based image forming device comprising:

a secondary roller including a reimageable surface layer in rolling contact with the rotatable inking blanket at a nip therebetween, the reimageable surface layer having a textured surface with pixel sized lands surrounded by sharp edges between the lands, the textured surface designed to reduce lateral spreading of fountain solution via contact pinning of the fountain solution on the textured surface, the secondary roller further including a hollow core with a central drum chiller configured to chill the reimageable surface to a freezing temperature of the fountain solution;

a fountain solution deposition system adjacent the secondary roller, the fountain solution deposition system configured to deposit a layer of fountain solution onto the reimageable surface layer, the fountain solution deposition system including a vapor development device having a manifold with walls defining a chamber adjacent the reimageable surface layer for transfer of fountain solution vapor into the chamber and condensation of the fountain solution vapor onto the reimageable surface layer as the layer of fountain solution;

a pixelated heat source adjacent the secondary roller and downstream the fountain solution deposition system, the pixelated heat source configured to vaporize the layer of fountain solution in an image-wise manner from the reimageable surface layer and form a patterned fountain solution latent image on the reimageable surface layer, wherein the secondary roller transfers at least a portion of the patterned fountain solution latent image to the rotatable inking blanket at the nip.

20. The image forming device of claim 19, wherein the textured surface includes pixel sized lands having a width less than about 30 μm, the pixel sized lands have low-surface energy coating between the sharp edges that decreases the surface energy of the textured surface.

* * * * *